United States Patent [19]

Greer

[11] 4,170,357

[45] Oct. 9, 1979

[54] GOLF CLUB

[76] Inventor: George C. Greer, 2115 N. Crater La., Newberg, Oreg. 97132

[21] Appl. No.: 896,710

[22] Filed: Apr. 17, 1978

[51] Int. Cl.[2] ..... A63B 53.04

[52] U.S. Cl. ..... 273/167 R

[58] Field of Search ..... 273/77 R, 78, 84 R, 273/ 162 R, 167-175, 183 D, 186 A, 193 R, 194 R; 46/196, 200; 124/2

[56] References Cited

U.S. PATENT DOCUMENTS

| | | | |
|---|---|---|---|
| 769,939 | 9/1904 | Clark | 273/162 R X |
| 881,150 | 3/1908 | Post | 46/196 |
| 2,634,535 | 4/1953 | Borders | 273/84 R X |
| 3,309,813 | 3/1967 | Newlan et al. | 46/196 X |

FOREIGN PATENT DOCUMENTS

| | | | |
|---|---|---|---|
| 1181539 | 1/1959 | France | 273/167 J |

OTHER PUBLICATIONS

Ahern, "The Puffle Booster Driver" (cartoon); Times Union (Albany), Apr. 20, 1956, at 31.

*Primary Examiner*—Richard J. Apley
*Attorney, Agent, or Firm*—Klarquist, Sparkman, Campbell, Leigh, Hall & Whinston

[57] ABSTRACT

A golf club head contains a barrel with a rearward facing muzzle. The barrel is adapted to contain a propellant charge held in place by a combined breech block and firing pin mechanism. When the ball-striking face of the club head hits a golf ball, the propellant charge is detonated to push the club head forward with increased energy.

11 Claims, 3 Drawing Figures

FIG. 1
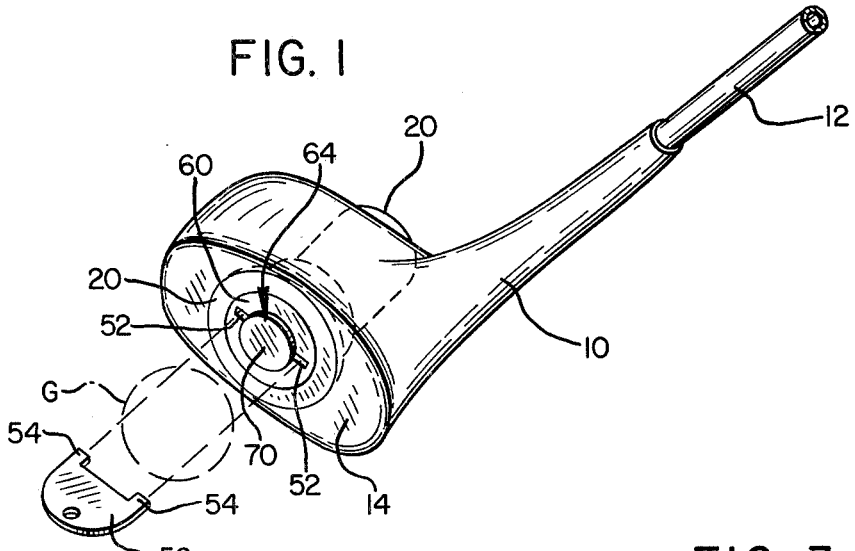
FIG. 3
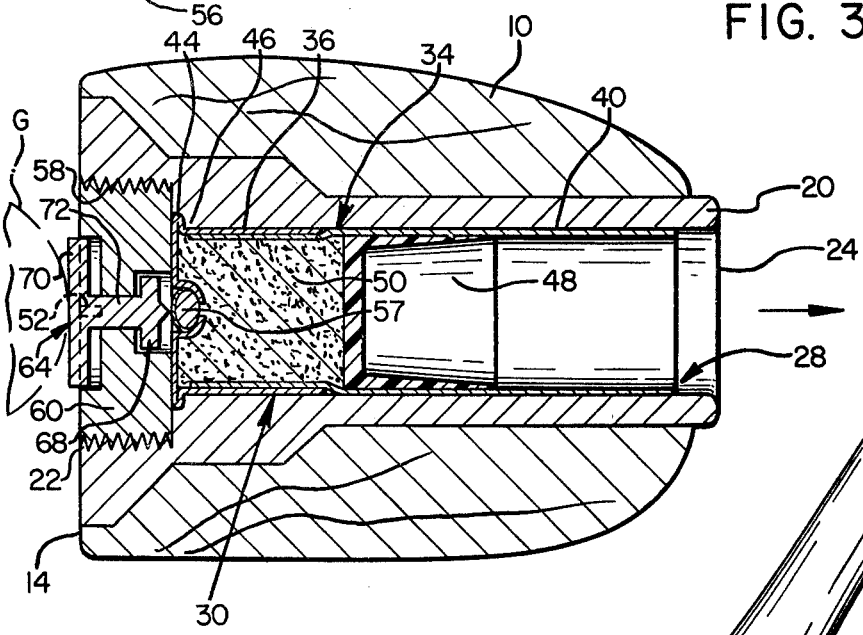
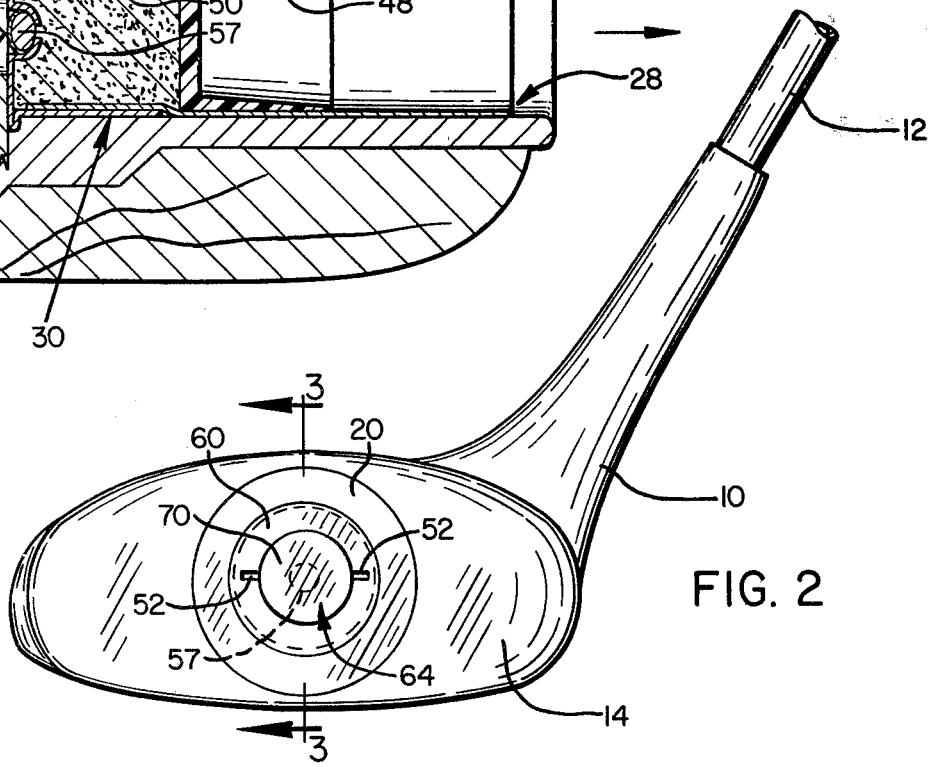
FIG. 2

GOLF CLUB

BACKGROUND OF THE INVENTION

The present invention relates to athletic clubs and bats used for striking balls. More specifically it relates to golf clubs assisted by explosive charges to increase the distance to which a golf ball can be driven.

The use of explosive charges has previously been suggested to extend the distance of golf drives. Prior mechanisms suggested for this purpose have not, however, been suitable. Typically, such devices have included a mechanism for pushing a ball away from the club head at the moment of impact. Such mechanisms are unsuitable because they substantially hinder the golfer's follow-through by urging the club to decelerate.

Some prior clubs use what is essentially a muzzle loading mechanism which includes a key that is inserted into the muzzle. An accidental discharge while using such a mechanism could be very dangerous.

SUMMARY OF THE INVENTION

To alleviate these problems of the prior art, the present invention includes a breech leading mechanism for accelerating a golf club head toward the golf ball. Acceleration toward the ball enhances the normal golf stroke, including the follow-through, and does not feel unnatural to the golfer.

The mechanism of the present invention is simple, easy to use and completely safe, when used properly.

It is an object of the invention to provide an athletic club or bat which, when it strikes a ball, will be propelled with added energy in the direction of the ball to increase the distance to which the ball is projected.

A further object is to provide a club as aforesaid, which is safe and easy to use.

Another object is to provide a club having a propulsion mechanism with a minimum of parts and with no interior parts which would necessitate disassembly of the entire apparatus for repair.

Other objects and advantages of this invention will become apparent to those skilled in the art upon reading the specification.

BRIEF DESCRIPTION OF THE DRAWING

FIG. 1 is an oblique view of a golf club head constructed according to the present invention;

FIG. 2 is an enlarged front view of the club head shown in FIG. 1; and

FIG. 3 is an enlarged sectional view taken along lines 3—3 of FIG. 2.

BRIEF DESCRIPTION OF A PREFERRED EMBODIMENT

A golf club for making long distance drives includes a wooden head portion 10 mounted at one end of a shaft 12 which terminates in a handle (not shown) at its other end. The head portion 10 has a flat face 14 for striking a golf ball G. The face 14 is oriented relative to the club so that, as a result of a successful swing, the club head 10 will contact the ball B at the center of the face 14.

As shown in FIGS. 1–3, a barrel member 20 extends entirely through the head portion 10 substantially perpendicularly to the flat face 14. The barrel has a breech end 22 located at the flat face 14 and a muzzle end 24 located at the opposite side of the head portion 10. And, the barrel's interior defines a chamber 28 which is properly dimensioned to receive a cartridge 30.

The cartridge is preferably of the type used in shotguns; but it should not include any projectile pellets. FIG. 3 shows a suitable cartridge having a casing 34 which includes a metallic cylinder 36 and an outer tube 40, preferably of paper or plastic material. A flange 44 extends radially from the cylinder 36 to retain the cartridge 30 behind a shoulder 46 defined by the barrel. Wadding material 48 is provided to retain a propelling charge 50 inside the cylinder 36; and a primer cap 57 is provided to detonate the propelling charge.

Near its breech end, the barrel increases in diameter and defines a cylindrical opening 58 of larger diameter than the chamber 28. That portion of the barrel which defines the opening is internally threaded to mate with the external threads of a cylindrical breech block 60. The breech block 60 can thus be screwed into the opening 58 to retain the cartridge 30 inside the chamber 28 with the cartridge's flange 44 against the shoulder 46 of the barrel.

Mounted on the breech block 60 is a firing pin 64 which includes inner and outer portions 68, 70 and a central shaft 72 which extends through the breech block 60. The firing pin is positioned such that, when the breech block is installed in the opening 58, the shaft 72 is axially aligned with the barrel, the inner portion 68 is positioned to contact the primer cap 57 and the outer portion 70 extends outwardly of the ball striking face 14. With the breech block 60 installed, the outer faces of the breech block 60, the breech end 22 of the barrel member and the flat face 14 are coplanar so that only the outer firing pin portion 70 extends outwardly of the common plane. The firing pin 64 is permanently retained in the breech block 60, but is constructed so that it can slide axially through the breech block.

The breech block defines two slots 52 to receive tines 54 of a forked key 56. The tines 54 may be inserted in the slots 52 and the key 56 rotated to install or remove the breech block 60.

Operation

Operation of the present invention should be readily apparent from the FIGS. 1–3. Prior to driving a ball, a golfer uses the key 56 to remove the breech block 60 from the opening 58. A cartridge 30 is inserted into the chamber 28 and the breech block replaced in the opening. When these steps have been completed the club head will appear as shown in FIG. 3.

Next the golfer will perform his normal driving swing. If the swing is straight and true, the ball G will contact the outer portion 70 of the firing pin 64. This will drive the inner portion 68 of the pin 64 against the primer cap 57 which will explode and detonate the propellant charge 50. Upon detonation the propellant charge 50 will be converted into hot gasses which will be discharged along with the wadding material 48 through the muzzle 24 of the barrel member 20. The discharge of gasses from the cartridge 30 will accelerate the club head 10 toward the ball G imparting additional energy to the ball and extending the distance to which it is driven. If the ball hits the flat face 14 off-center, the charge will not be detonated so that drives which would normally be out of bounds are not extended by the explosive device.

Once a drive is completed, the key 56 is used to again remove the breech block 60; and the expended cartridge 30 is removed by hand. A fresh cartridge is placed in the chamber 28 and the breech block replaced so that the club will be ready to reuse. By taking care not to place his hand over the muzzle end 24, a golfer may perform the reloading operation in complete safety.

While I have shown and described a preferred embodiment of my invention, it will be apparent to those skilled in the art that changes and modifications may be made without departing from my invention in its broader aspects. For example, the basic mechanism of the present invention could be employed in clubs and bats used for athletic purposes other than golfing. Using this mechanism, the distance to which a ball can be projected from any such implement can be increased.

I claim:

1. In an athletic club having a shaft portion extending between a handle portion and a head portion which includes a ball-striking face, the improvement wherein said head portion comprises:

propulsion means including a charge receiving means for holding and positioning a propellant charge such that when said charge is detonated, said heat portion is accelerated in the direction of said ball-striking face; and means for detonating a propellant charge held by said charge receiving means, when said ball-striking face comes into contact with a ball, to accelerate said head portion toward said ball.

2. The improvement of claim 1 wherein:

said charge receiving means includes a barrel means adapted to receive a cartridge containing such a propellant charge and to direct gases rearwardly away from said cartridge so that when such a cartridge is received by said barrel means, gases produced by the detonation of a propellant charge therein are directed substantially perpendicularly away from said ball-striking face to generate a propulsive force which urges said head portion in the direction of said ball-striking face; and said detonating means comprises a firing pin mechanism which, when said head contacts a ball with sufficient energy, strikes said cartridge to detonate said propellant charge.

3. The improvement of claim 2 wherein said barrel means comprises a substantially tubular barrel member having an open muzzle end which faces oppositely of said ball-striking face and a breech end adjacent said face, said barrel member defining a chamber to receive and retain said cartridge such that gases produced by the ignition of a propellant charge in such a cartridge are discharged through said muzzle end of said barrel.

4. The improvement of claim 3 wherein said barrel extends completely through said head substantially perpendiculary to said face.

5. The improvement of claim 3 wherein:

the interior of said barrel increases in size at its breech end to define an opening; and said propulsion means further comprises a breech block securable in said opening to abut a cartridge in said chamber and thereby retain said cartridge in a firing position.

6. The improvement of claim 5 wherein said firing pin mechanism comprises a firing pin which slidably extends through said breech block and which includes a central shaft and inner and outer end portions, said pin being positioned in said block such that, when said breech block is secured in said opening against a cartridge in said chamber, said shaft is axially aligned with said barrel, said inner portion is positioned to contact a primer cap on the cartridge and said outer end portion extends outwardly of said ball-striking face, whereby an impact of predetermined minimum energy between a ball and said outer end portion will cause said inner portion to strike and thus detonate said primer cap.

7. In an athletic club having a shaft portion extending between a handle portion and a head portion which include a ball-striking face, the improvement comprising:

a barrel member having a breech end and a muzzle end, said barrel member extending entirely through said head portion substantially perpendicularly to said face, said breech end being located at said ball-striking face and said muzzle end being located at a position on said head opposite said ball-striking face, said barrel defining a. a chamber of proper dimensions for receiving and retaining a cartridge containing a propelling charge and b. a cylindrical opening of larger dimensions located between said chamber and said breech end, the portion of said barrel defining said opening being internally threaded;

a cylindrical breech block threaded externally to mate with the interior threads of said opening so that said breech block can be screwed into said opening to retain a cartridge in said chamber; and a firing pin slidably extending through said breech block and including a central shaft and inner and outer end portions, said pin being positioned in said block such that, when said breech block is located in said opening and a cartridge is in said chamber, said shaft is axially aligned with said barrel, said inner end portion is positioned to contact a primer cap on the cartridge and said outer end portion extends outwardly of said ball-striking face, whereby an impact of predetermined energy between a ball and said outer end portion will cause said inner end portion to strike and thus detonate said primer cap.

8. The improvement of claim 1 wherein said charge receiving means comprises a rearwardly opening barrel which is substantially perpendicular to said face.

9. The improvement of claim 1 wherein all portions of said ball-striking face are substantially flat and made of a rigid material.

10. The improvement of claim 2 wherein:

said firing pin mechanism comprises a firing pin which slidably extends between said ball-striking face and said charge receiving means; and said barrel means is substantially straight and axially aligned with said firing pin in such a manner that, when a cartridge is received in said charge receiving means, said cartridge, said barrel means and said firing pin are aligned tangentially to the arc through which they move as said club is swung so that detonation of the propellant charge in said cartridge will cause said head portion to be accelerated along said arc.

11. In an athletic club having a shaft portion extending between a handle portion and a head portion which includes a ball-striking face, the improvement wherein said head portion comprises:

a generally straight barrel which extends at least partially through said club substantially perpendicularly to said face and has a rearwardly opening muzzle end;

a breech block portion located between said barrel and said face; and an unbiased, unitary firing pin slidably extending through said breech block portion, said pin having an outer end located adjacent said face and an inner end located adjacent said barrel, said barrel being constructed to receive and retain, at a fixed location relative to said head portion and adjacent said inner end of said firing pin, a cartridge of the type which contains a percussion detonatable propellant charge and has an openable end for the discharge of propellant gases, so that, when such a cartridge is received by said barrel with said openable end facing into said barrel and away from said firing pin and said outer end of said firing pin is impacted against a ball, said inner end of said pin strikes said cartridge and detonates said charge to create propellant gases which escape through said openable end and said rearwardly opening barrel to accelerate said head portion toward said ball.

* * * * *